United States Patent [19]

Nagata

[11] Patent Number: 4,819,861

[45] Date of Patent: Apr. 11, 1989

[54] PAPER CONTAINER FOR LIQUID

[75] Inventor: Kiichiro Nagata, Tokyo, Japan

[73] Assignee: Jujo Paper Co., Ltd., Tokyo, Japan

[21] Appl. No.: 9,890

[22] Filed: Feb. 2, 1987

[30] Foreign Application Priority Data

Feb. 12, 1986 [JP] Japan ..... 61-18650[U]

[51] Int. Cl.[4] ..... B65D 5/42

[52] U.S. Cl. ..... 229/16 R; 229/920; 229/DIG. 4; 428/172; 428/34.2

[58] Field of Search ..... 229/16 R, DIG. 14, 920, 229/137; 428/35, 156, 172

[56] References Cited

U.S. PATENT DOCUMENTS 3,098,599 7/1963 Hagan ..... 229/132
4,291,826 9/1981 Swanson ..... 229/DIG. 4
4,586,650 5/1986 Sasaki et al. ..... 229/DIG. 4

FOREIGN PATENT DOCUMENTS

82/04025 11/1982 PCT Int'l Appl. .

*Primary Examiner*—Stephen Marcus
*Assistant Examiner*—Gary E. Elkins
*Attorney, Agent, or Firm*—Holman & Stern

[57] ABSTRACT

A paper container for containing liquid such as milk and juice is disclosed. The container is formed of a thick paper provided thereon with vertical and horizontal folding lines intersecting each other at right angles. The intersecting portions of the folding lines are such formed as to be different in configurations for a predetermined length. In this way, splits and pin holes can be prevented from occurring when the thick paper is folded along the grooves to build up a container.

10 Claims, 4 Drawing Sheets

PAPER CONTAINER FOR LIQUID

BACKGROUND OF THE INVENTION

This invention relates to a paper container for containing liquid such as milk and juice and sold at retail. More particularly, the invention relates to a paper container for liquid which is formed by folding a thick paper coated with polyethylene, aluminum and the like along several vertical and horizontal folding line grooves provided on the paper.

Conventional containers of this type are usually formed by providing folding line grooves on a bare thick paper and thereafter applying polyethylene, aluminum and the like on the paper in several layers and bonding thereof.

When such thick paper is folded along the folding line grooves to build up a container, splits and pin holes are likely to occur in the area near the folding line grooves.

Regarding the structure of folding lines at the area near the instersection of the vertical and horizontal folding line grooves, several proposals have been made. According to such proposed structure of folding lines, the folding lines have interrupted portions and, at the interrupted portions, the folding lines are replaced with two side fold lines running in the main direction. Due to the foregoing, the thick paper is more sharply folded at the interrupted portions of the folding lines and the expansion of the thick paper becomes small at the folded portion, and therefore the tensile stress occurred to the ourter side of the thick paper is eased.

When a container is built up by folding a composite thick paper along several folding line grooves formed thereon, the following tendency is likely to occur. That is, when the paper is folded by 180° along one of the folding line grooves, the inner side of the center line of the thickness of the thick paper is contracted, while the outer side is expanded. Because of the foregoing, a compression pressure is applied to the inner side and a tensile stress is applied to the outer side.

Although there is almost no problem on the inner portion which receives the compression pressure, the outer portion is tended to have splits and pin holes at the layer portion due to the tensile stress. This is especially true when an aluminum layer is formed. Although such splits and pin holes are not produced by only one trial of 180° folding, when the folded portion of the thick paper is further folded by 180° in the direction perpendicular thereto or when a portion where two sheets of thick paper overlapped each other is folded twice in the manner as just mentioned, the tensile stress applied to the layer portion situated at the outer side becomes larger and splits and pin holes are likely to take place.

In the development view of a container shown in FIG. 11, the intersecting portion between the folding line grooves 2 and 8 are the intersecting portion between the folding line grooves 3 and 8 are formed of two sheets of thick paper overlapped each other, and these overlapped thick paper portions are once folded by 180° along the horiziontal folding line groove 8 and thereafter folded again by 180° in the perpendicular direction to build up a container. FIG. 12 shows the configuration of this portion, and FIGS. 13 and 14 are sectional views thereof.

In FIG. 13, the paper layers 105-103-110 hold at the inner sides thereof four paper layers 106, 107, 108 and 109, and are folded by 180°. Accordingly, the maximum tensile stress is produced at the outer side of the paper layer 3. Further, since this portion is already folded by 180° as denoted by 109, 100 in FIG. 12, a secondary tensile stress is produced.

From the foregoing, the widths of folding line grooves on the paper layers 105, 103, 110 of FIG. 10 are desirably five times of the thickness of a sheet of paper or single paper layer.

In order to keep the width of the folding line grooves narrow, the thicknesses of the papers 105 through 110 should be formed thin.

As described in the foregoing, if the widths of the folding line grooves are formed wide or otherwise if the thicknesses of the paper layers around the folding line grooves are formed thin according to the configuration of the folding paper layers, i.e., the number of layers at the portion where the papers are folded and to the folding angles thereof, the tensile stress produced at the outer side of the paper layers can be eased.

SUMMARY OF THE INVENTION

An object of the present invention is to provide a paper container for liquid, wherein the tensile stress is eased in order not to produce splits and pin holes.

In order to achieve the above object, there is essentially provided means in which the configuration of an intersecting portion of vertical and horizontal folding line grooves for forming a container is different for a predetermined length.

DETAILED DESCRIPTION OF THE PREFERRED EMBODIMENTS

Figure 1:
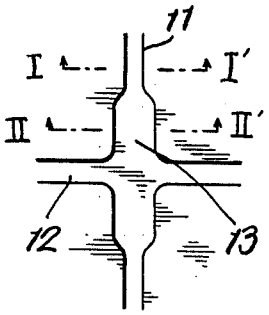
FIG. 1 is a plan view of an important portion of a paper container for liquid according to one embodiment of the present invention.
Figure 2:
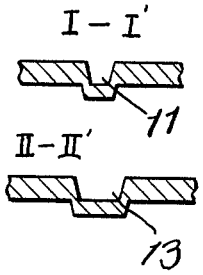
FIG. 2 is a sectional view taken on lines I—I' and II—II' of FIG. 1.

Referring first to FIG. 1 showing one preferred embodiment of the preset invention, vertical and horizontal folding line grooves 11 and 12 have at the intersecting portion a wide width portion 13 having a different configuration from the remaining folding line grooves.

Figure 3:
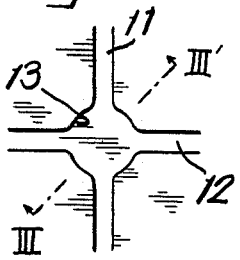
FIG. 3 is a plan view of an important portion according to a second embodiment of the preset invention.
Figure 4:
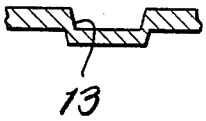
FIG. 4 is a sectional view taken on line III—III' of FIG. 3.
Figure 7:
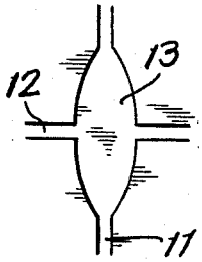
FIG. 7 is a plan view of a fourth embodiment of the present invention.
Figure 8:
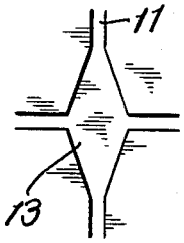
FIG. 8 is a plan view of a fifth embodiment of the present invention.

This wide width portion 13 may take any shape including, for example, a round shape as shown in FIG. 3, an oval shape as shown in FIG. 7 and a diamond shape as shown in FIG. 8. In short, it suffices as long as the folding line grooves 11 and 12 are formed wide for a predetermined length. Due to the foregoing arrangement, there can be eased the stress to be produced at the vertical folding line groove 11 and the horizontal folding line groove 12.

Figure 5:
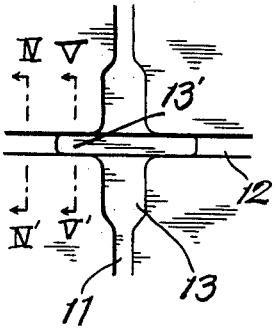
FIG. 5 is a plan view of a third embodiment of the present invention.
Figure 6:
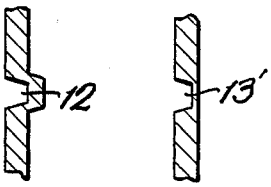
FIG. 6 is a plan view taken on lines IV—IV' and V—V' of FIG. 5.

As shown in FIGS. 5 and 6, when the paper layer of the horiziontal folding line groove 12 is formed thin as denoted by numeral 13' at the intersecting portion, the folding action can be made sharp and the tensile stress can be eased. The thin portion 13' is preferably 10/10 to 5/10 of a thick paper.

Figure 9:
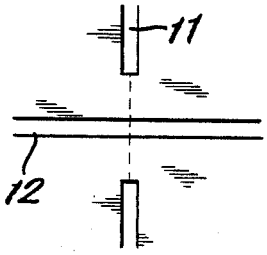
FIG. 9 is a plan view of a sixth embodiment of the present invention.
Figure 10:
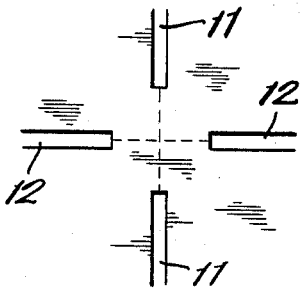
FIG. 10 is a plan view of a seventh embodiment of the present invention.
Figure 11:
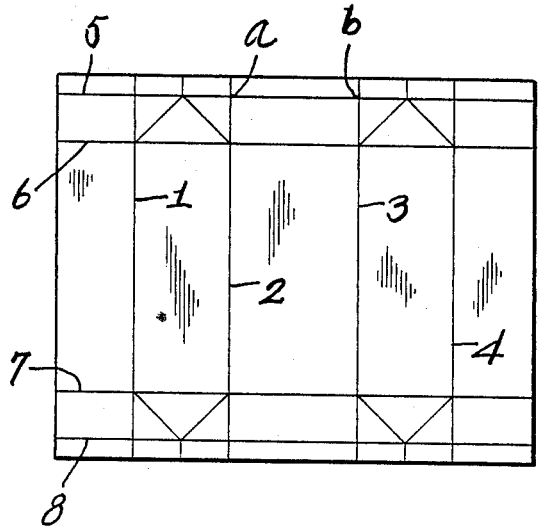
FIG. 11 is a development view of a container.
Figure 12:
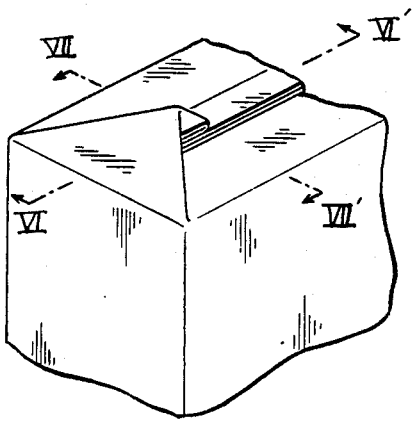
FIG. 12 is a perspective view of a part of a container built up.
Figure 13:
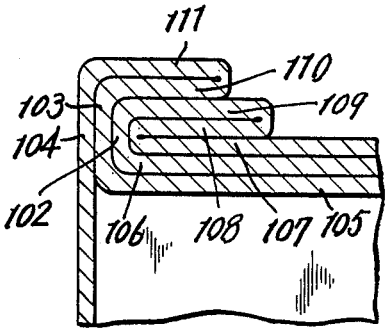
FIG. 13 is a sectional view taken on line VI—VI' of FIG. 12.
Figure 14:
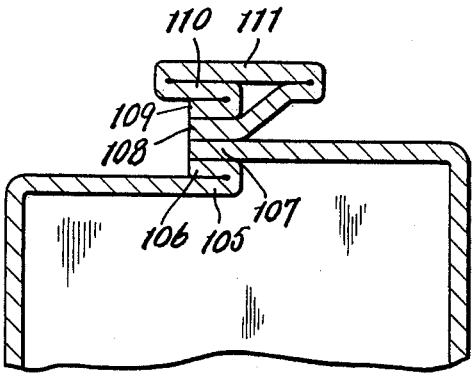
FIG. 14 is a sectional view taken on line VII—VII' of FIG. 12.

According to another embodiment shown in FIG. 9, one of the folding line grooves 12 (horizontal groove in the figure) is provided at the intersecting portion but the other groove 11 (vertical groove in the figure) is not provided at the intersecting portion. According to a further embodiment shown in FIG. 10, both the vertical and horizontal folding line grooves 11 and 12 are separated at the intersecting portion to form a different shape portion.

According to the present invention, no splits and no pin holes are produced on the aluminum layer and the polyethylene layer as a layer portion of the thick paper. Thus, leakage of liquid contained in the container can be prevented and entrance of air and bacteria into the container from outside can be prevented.

What is claimed is:

1. A paper container for liquid comprising a plurality of vertical folding line grooves and a plurality of horizontal folding line grooves intersecting said vertical line grooves at right angles, wherein at least one of said vertical and horizontal folding line grooves is formed different in configuration in its width for a predetermined length at the intersecting portion, said one of the vertical and horizontal folding line grooves formed at the intersecting portion is formed thinner than the other.

2. A paper container for liquid as claimed in claim 1, wherein said wide width portion at the intersecting portion is provided to both said vertical and horizontal folding line grooves.

3. A paper container for liquid as claimed in claim 1, wherin the width of said folding line groove is within 1 to 6 times of the thickness of a thick paper.

4. A paper container for liquid as claimed in claim 1 wherein the contour of said wide width portion at the intersecting portion is linear.

5. A paper container for liquid as claimed in claim 1, wherein the contour of said wide width portion at the intersecting portion is curved.

6. A paper container for liquid as claimed in claim 2, wherein said wide width portion at the intersecting portion is formed in a circular shape on both the vertical and horizontal folding line grooves.

7. A paper container for liquid as claimed in claim 2, wherein said wide width portion at the intersecting portion is formed in an oval shape on both the vertical and horizontal folding line grooves.

8. A paper container for liquid as claimed in claim 2, wherein said wide width portion at the intersecting portion is formed in a diamond shape on both the vertical and horizontal folding line grooves.

9. A paper container for liquid as claimed in claim 1, wherein at least one of the vertical and horizontal folding line grooves is not partly provided.

10. A paper container for liquid comprising a plurality of vertical folding line grooves and a plurality of horizontal folding line grooves intersecting said vertical line grooves at right angles, wherein at least one of said vertical and horizontal folding line grooves is formed different in configuration in its width for a predetermined length at the intersecting portion, said one of the vertical and horiziontal folding line grooves formed at the intersecting portion is formed thinner than the other and wherein said thin portion of the folding line grooves is 10/10 to 5/10 of a thick paper.

* * * * *